US008348460B2

(12) United States Patent
Bachl et al.

(10) Patent No.: US 8,348,460 B2
(45) Date of Patent: Jan. 8, 2013

(54) LIGHTING APPARATUS WITH SEVERAL LIGHT UNITS ARRANGED IN A HEATSINK

(75) Inventors: Bernhard Bachl, Regensburg (DE); Bernd Bienek, Oberhausen (DE); Olaf Cladders, Kamp-Lintfort (DE); Henning Dieker, Meerbusch (DE); Christian Miesner, Toenisvorst (DE); Lothar Schopmann, Kamp-Lintfort (DE); Herfried Zimmer, Oberhausen (DE); Daniel Sekowski, Lafayette, IN (US); Mark Anthony Hand, Covington, GA (US)

(73) Assignee: ABL IP Holding LLC, Conyers, GA (US)

( * ) Notice: Subject to any disclaimer, the term of this patent is extended or adjusted under 35 U.S.C. 154(b) by 48 days.

(21) Appl. No.: 12/434,282

(22) Filed: May 1, 2009

(65) Prior Publication Data

US 2010/0277914 A1 Nov. 4, 2010

(51) Int. Cl.
*F21S 4/00* (2006.01)

(52) U.S. Cl. ..... 362/249.01; 362/294; 362/264; 362/249.02; 362/218

(58) Field of Classification Search ..... 362/294, 362/264, 218, 249.01, 249.02
See application file for complete search history.

(56) References Cited

U.S. PATENT DOCUMENTS

| | | | | |
|---|---|---|---|---|
| 7,021,799 | B2 * | 4/2006 | Mizuyoshi | 362/373 |
| 7,528,421 | B2 * | 5/2009 | Mazzochette | 257/99 |
| 7,611,260 | B1 * | 11/2009 | Lin et al. | 362/224 |
| 7,815,338 | B2 * | 10/2010 | Siemiet et al. | 362/218 |
| 2004/0095782 | A1 * | 5/2004 | Isoda | 362/555 |
| 2005/0281033 | A1 * | 12/2005 | Coushaine et al. | 362/294 |
| 2007/0029564 | A1 * | 2/2007 | Han et al. | 257/98 |
| 2007/0090737 | A1 * | 4/2007 | Hu et al. | 313/11 |
| 2008/0130289 | A1 * | 6/2008 | Takemoto et al. | 362/294 |
| 2008/0266885 | A1 * | 10/2008 | Sun et al. | 362/373 |
| 2009/0101921 | A1 * | 4/2009 | Lai | 257/88 |
| 2009/0134421 | A1 * | 5/2009 | Negley | 257/98 |
| 2009/0154164 | A1 * | 6/2009 | Hsu et al. | 362/267 |
| 2009/0185379 | A1 * | 7/2009 | Chen | 362/294 |
| 2010/0014281 | A1 * | 1/2010 | Kim | 362/97.2 |

FOREIGN PATENT DOCUMENTS

| | | |
|---|---|---|
| JP | 2009094213 | 4/2009 |
| WO | WO 2006/046981 | 5/2006 |
| WO | WO 2008/137618 | 11/2008 |

* cited by examiner

*Primary Examiner* — Evan Dzierzynski
(74) *Attorney, Agent, or Firm* — Kilpatrick Townsend & Stockton LLP

(57) ABSTRACT

In a lighting apparatus, comprising a heatsink having at one side thereof a recess with at least one groove extending over the length of the heatsink, a plurality of lighting units are arranged in the groove or grooves oriented toward the opening of the recess for the emission of light therefrom and the frame is provided at the side opposite the opening with heatsink ribs, the lighting units in the groove or grooves being encapsulated by an encapsulating material added into the groove or grooves and being cured therein so as to be in direct contact with the groove walls and enclosing the lighting units at least up to the light emitting lenses thereof.

27 Claims, 3 Drawing Sheets

LIGHTING APPARATUS WITH SEVERAL LIGHT UNITS ARRANGED IN A HEATSINK

BACKGROUND OF THE INVENTION

The invention resides in a lighting apparatus for lighting purposes, particularly for use outside of protected spaces. The lighting apparatus includes several lighting units comprising particularly light emitting diodes (LEDs).

Light emitting diodes are often used in connection with switchboards as indicator signals. Because of their, in comparison with incandescent lights, high efficiency, there is an increasing demand for lighting arrangements based on light emitting diodes. However, for use in outside environments, for example in street lighting applications or in connection with motor vehicles, the individual lighting units of such a lighting arrangement must be protected from external influences in particularly weather conditions. At the same time, sufficient heat removal must be ensured in order to prevent the lighting units from being damaged by excessive heat.

It is therefore the object of the present invention to provide a lighting arrangement with several lighting units wherein the lighting units are protected from environmental influences while, at the same time, heat removal from the lighting units is ensured.

SUMMARY OF THE INVENTION

In a lighting apparatus comprising a heatsink having at one side thereof a recess with at least one groove extending over the length of the heatsink, a plurality of lighting units are arranged in the groove or grooves oriented toward the opening of the recess for the emission of light therefrom and the heatsink is provided at the side opposite the opening with heatsink ribs, the lighting units in the groove or grooves being encapsulated by a potting compound placed into the groove or grooves and being cured therein so as to be in direct contact with the groove walls and enclosing the lighting units at least up to light emitting lenses thereof.

In order to protect the lighting units from external influences, for example, detrimental weather conditions, the lighting units are, at least partially, encapsulated by a potting compound forming an enclosure. The lighting units are fully surrounded at least between the bottom of the recess and a weather resistant lens portion of the respective lighting unit by the enclosure which is added into the recess during assembly of the lighting equipment and which is then cured. The potted enclosure is preferably directly connected to the heatsink structure. Such a lighting unit is easy to manufacture. The heatsink structure forming the recess serves as cooling means and at the same time as a holder into which the encapsulating material is added during the manufacture of the illumination apparatus.

The heatsink structure may consist of a single part. In that case it is manufactured from only one material and has no joints such as welded or bonded parts. The heatsink structure may for example be a profiled section, in particular a profiled section formed by an extrusion press.

In the recess formed in the heatsink additional electronic components may be arranged which are fully covered by the encapsulant. A circuit board may be provided to which the lighting units, particularly the light emitting diodes arranged in the recess are mechanically connected. Also, other electrical or electronic components of the lighting apparatus may be populated on the circuit board. Between these components and for example between the circuit board and the heatsink body a heat-conductive layer in the form of a self-adhesive foil may be provided via which the circuit board can be attached in the recess.

Advantageously, the recess is in the form of a groove and is surrounded by two opposite groove walls. The heatsink body may be U-shaped in cross-section or may have a U-shaped contoured area so that the groove is formed between the U-legs. For example, the width of the groove in the transverse direction normal to the longitudinal direction of the groove may be at least 30-50% greater than the width of the components arranged in the groove and, in particular, greater than the width of the circuit board. In this way a sufficiently good mechanical contact between the protective casting material and the bottom of the groove is ensured.

The two groove walls and two of the heatsink ribs provided on the bottom side may form the two outer side surfaces of the heatsink body, which outer surfaces have no projections and recesses. The width of the heatsink ribs is preferably about 5-20% of the width of the groove.

The heatsink body may be provided with several grooves which extend parallel to one another and in each of which several lighting units are arranged. In this way, a matrix-like arrangement of the lighting units may be formed. For improved heat removal, an air gap may be provided between two adjacent grooves, more specifically between the walls of two adjacent grooves.

Further features and advantageous embodiments of the invention will become more readily apparent from the following description of the invention on the basis of the accompanying drawings. However, the description is concerned with the important aspect of the invention. Certain additional details are apparent from drawings.

DETAILED DESCRIPTION OF PARTICULAR EMBODIMENTS

Figure 1:
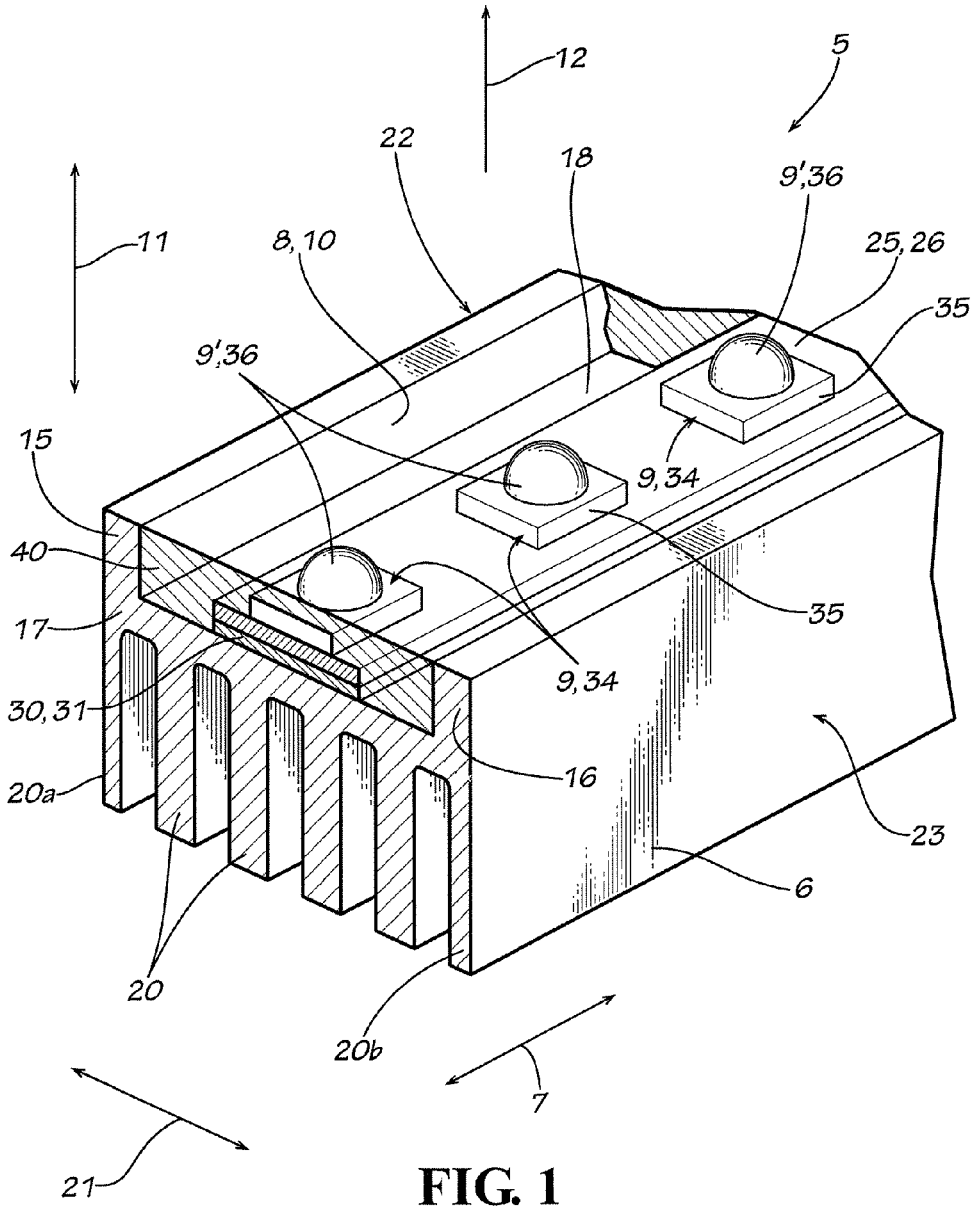
FIG. 1 is a partial perspective view of a lighting apparatus according to the invention.

FIG. 1 shows a first embodiment of a part of lighting apparatus 5 in a cross-sectional perspective view. The lighting apparatus 5 comprises a heatsink body 6, which may constructed of metal, especially aluminum. The heatsink body 6 is an elongated body which may extend in the longitudinal direction 7 up to 2 meters. The heatsink body 6 may be cast or it may be formed as an extruded section. The heatsink body 6 is a single part which is constructed entirely of the same material. As a result, it includes no joints such as welded or bonded areas or other areas where parts are joined by some connecting procedure.

The heatsink body 6 includes a recess 8 in which several lighting units 9 of the lighting apparatus 5 are arranged. The recess 8 is in the form of a groove 10 which extends in the longitudinal direction 7 over the full length of the heatsink body 6. The groove 10 is in a cross-sectional view rectangular and is open in a height direction 11 extending normal to longitudinal direction 7. In the recess 8, lighting units 9 are so arranged that light generated thereby can be radiated off over a radiation angle range around the light emission direction 12. The light radiation angle range depends on the design of the lighting units 9 and the spatial conditions between the lighting units 9 and the heatsink body 6.

The groove 10 is surrounded on the sides by walls 15, 16, which are interconnected via a plate- or strip-like base part 17. The base part 17 includes, adjacent to the groove 10, a planar surface which forms the bottom wall 18 of the groove 10. In the area of the groove 10, the heatsink body 6 is U-shaped in cross-section, the two legs of the U-shape being formed by the groove walls 15, 16.

At its side opposite the light emission direction 12, the heatsink body 6 is provided with several heatsink ribs 20. The heatsink ribs 20 extend from the base part 17 in the height direction 11 in parallel. However, heatsink ribs may also be provided on the side walls 15, 16 so as to extend essentially sidewardly in a transverse direction 21 normal to the height direction 11.

In the transverse direction 21, the heatsink ribs 20 which extend in the height direction 11 are for example evenly spaced from one another. The distance between adjacent heatsink ribs 20 in the transverse direction 21 corresponds essentially to the width of the intermediate heatsink ribs 20. The, in transverse direction, outer heatsink ribs 20*a*, 20*b* form together with the groove walls 15, 16 which are arranged in the height direction 11 in the same plane, outer opposite side surfaces 22, 23 of the heatsink body 6. The two outermost heatsink ribs 20*a*, 20*b* have, in the transverse direction 21, about half the width of the intermediate heatsink ribs 20, which are arranged in between. The thickness of the groove walls 15, 16 corresponds about to the thickness of the intermediate heatsink ribs 20. In the transverse direction 21, the width k of the intermediate heatsink ribs 20 is about 10-15% of the width n of the groove 10. Alternatively, the width k of the intermediate heatsink ribs 20 may be in the range of 5-20% of the width n of the groove 10.

The height of the groove walls 15, 16 from the base 18 of the groove 10 in the height direction 11 is in the preferred embodiments in the range of 15-45%, particularly about 35% of the width n of the groove 10. The height of the heatsink ribs 20, 20*a*, 20*b*, in the height direction 11 may be about twice the height of the groove walls 15, 16.

The lighting units 9 are arranged in the recess 8 formed by the groove 10. Additional electrical and electronic components 25 may also be accommodated in the recess 8. One of the electronic components 25 is for example a circuit board 26 which extends in the recess 8 in the longitudinal direction 7. The lighting units 9 are arranged on the circuit board 26 and are connected to the circuit board 26 mechanically as well as electrically. The lighting units 9 are arranged on the circuit board 26 in a row and uniformly spaced. Alternatively, several rows of lighting units 9 may be arranged on the circuit board 26 in side-by-side relationship. Also, several circuit boards 26 with one or more rows of lighting units 9 may be arranged in a recess 8. However, for clarity reasons, additional electric or electronic components arranged on the circuit board or in the recess 8 are not shown in FIGS. 1 and 2 of the first embodiment of the lighting apparatus 5. Also, the conductors of the circuit board 26 are not shown in order to provide for a clear representation of the arrangement.

Figure 2:
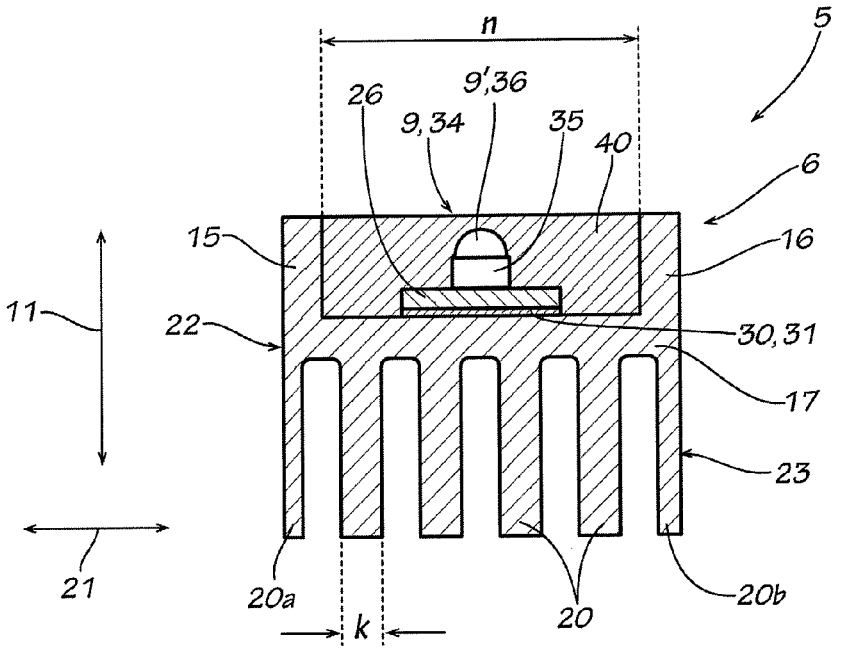
FIG. 2 shows the lighting apparatus according to FIG. 1 in a cross-sectional view.
Figure 3:
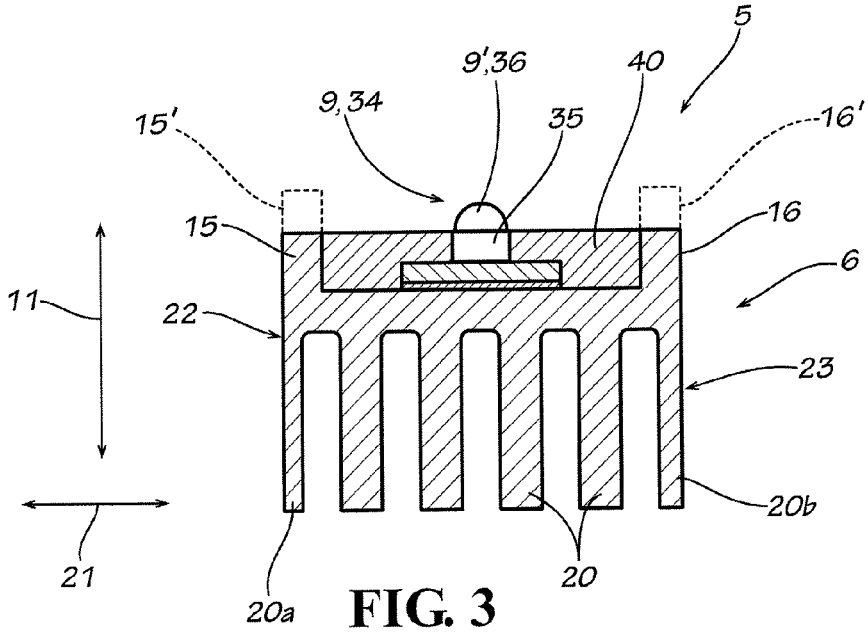
FIG. 3 is a cross-sectional view of a modified embodiment of the lighting apparatus.

From the embodiment according to FIGS. 1 and 2, it is apparent that the height of the groove walls 15, 16 and correspondingly the depth of the groove 10 is at least as large as the height of lighting units 9 arranged in the groove 10 or, respectively, other components 25. Neither the lighting units 9, nor any of the components 25 project from the recess 8 formed by the groove 10. However, alternatively an arrangement may be provided wherein the weather-resistant parts of the lighting units 9 extend in height direction 1 beyond the groove walls 15, 16 and, accordingly project from the recess 9 or, respectively, the groove 10 (FIG. 3).

Between the circuit board 26 and the heatsink body 6 and, as shown in the example embodiment, between the circuit board 26 and the groove base 18 formed by the base part 17, a heat conductive layer 30 is disposed which extends in a strip below the circuit board 2*b* and which has a width in the transverse direction 21 corresponding essentially to the width of the circuit board 26. The heat conducting layer 30 may at the same time act as an insulation layer in order to prevent an electric connection between the heatsink body 6 and the electrical or, respectively, electronic components 9, 25, 26 provided in the recess 8. In the present case, the heat conductive layer is a double-sided self-adhesive foil, particularly a plastic foil 3 by way of which the circuit boards 26 can be attached to the base 18. In the preferred embodiment, the circuit board 26 extends transversely along the center of the groove 10. The lighting units 9 disposed on the circuit board 26 are also disposed in the center of the groove 10. The width n of the groove 10 is at least 30-50% greater than the width of the circuit board 26 disposed in the groove 10.

Preferably, the lighting units 9 comprise light-emitting diodes 24, which include each a diode chip 35 and a light transparent diode body 36 which may also be designated as a diode lens. The diode body 36 may consist for example of a light-transparent resin. A plurality of such light emitting diodes 34 are combined in the lighting apparatus 5 to form an assembly providing the desired lighting effect.

In order to protect the lighting units 9 formed by the light emitting diodes 34 from detrimental external influences, in particular from weather influences, they are enclosed by a potting compound encapsulant 40 which fills the recess 8 at least to such an extent that the weather-sensitive parts, particularly the diode chips 35 of the light-emitting diodes 34, are completely encapsulated. The electrical or electronic components 25 and particularly the circuit board 26 are also surrounded by the encapsulant 40 and are therefore also protected.

The encapsulant 40 is at the groove walls 15, 16 and the groove base 18 in direct contact with the heatsink body 6, whereby a good mechanical connection is provided between heatsink body 6 and the encapsulant 40. Preferably, the groove 10 is completely filled by the encapsulating material. The top side of the encapsulant 40 in the light emission direction 12 of the lighting units 9 is at the level of the free ends of the groove walls 15, 16.

In accordance with FIGS. 1 and 2, the encapsulant 40 completely surrounds and covers the lighting units 9. The encapsulant 40 is light transparent and may be clear or colored, depending on the wavelength of the light emitted by the light emitting diodes 34.

Alternatively, it is also possible to leave a lens part 9' of the lighting unit 9 uncovered as it is shown in the embodiment of FIG. 3. In this case, the lens part 9' is formed by the diode body 36. This lens part 9' or, respectively, the diode body 36 projects for example from the recess 8 and, accordingly, remains uncovered during casting of the enclosure 40. However, the recess 8 may also be dimensioned in the height direction 11 in such a way that the lighting unit 9 does not project from the recess which is only partially filled with the encapsulating material so that the lens part 9' projects from the encapsulant as it is shown in FIG. 3 by the pointed line sections 15', 16' of the groove walls 15, 16. If the lens part 9' is not covered by the encapsulant 40, the encapsulating material may also be opaque since the light of the lighting unit 9 is emitted via the lens part 9' and does not need to pass through the encapsulant 40. In this embodiment, a high operating efficiency can be achieved.

The encapsulant 40 consists of a potting compound such as a plastic or a resin for example polyurethane or silicone. The encapsulant is weather resistant and may also be fire retardant.

Figure 4A:
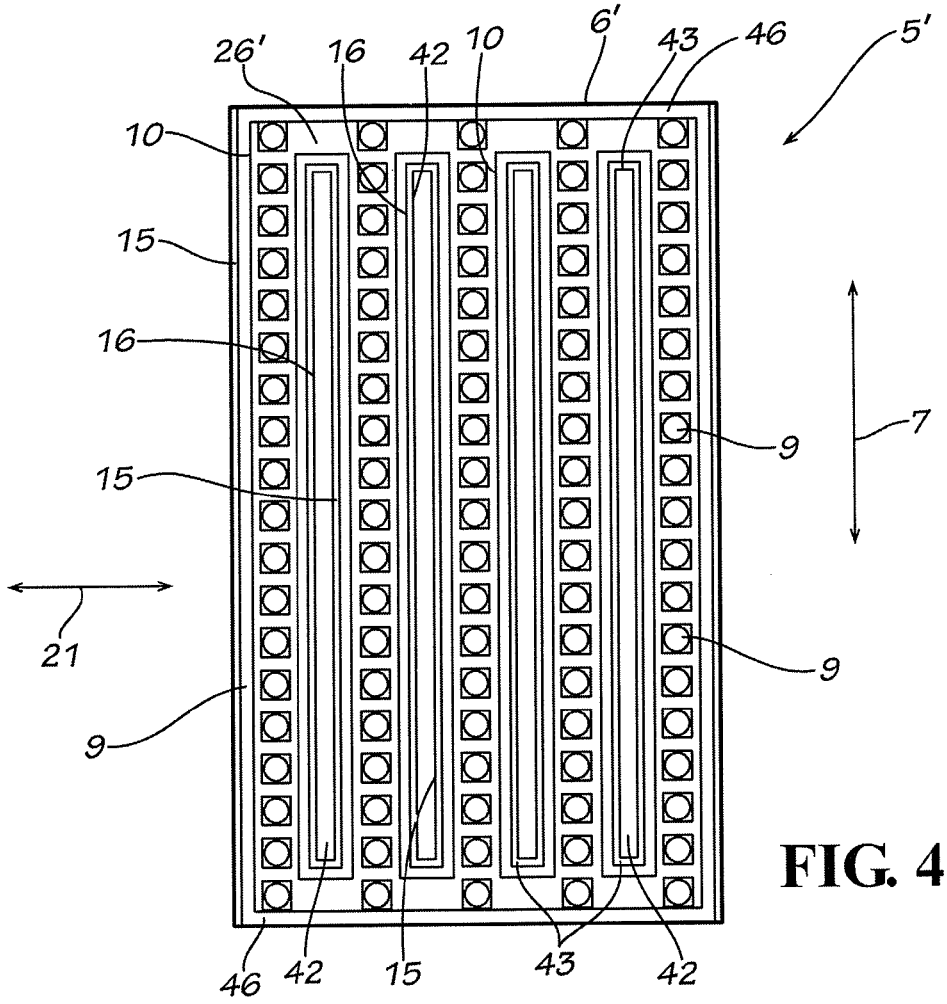
FIG. 4A is a planar view of an embodiment of the lighting apparatus including several rows of lighting units.
Figure 4B:
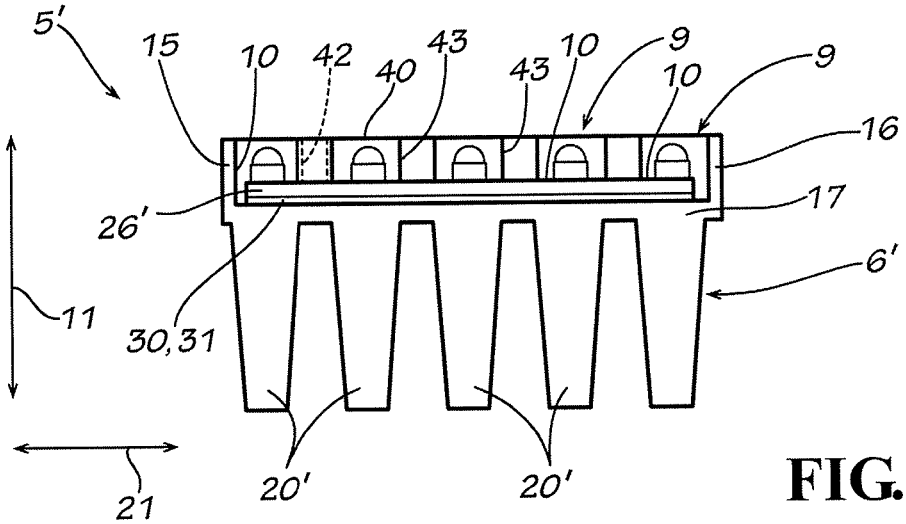
FIG. 4B is an end view of the lighting apparatus shown in FIG. 4A.

FIGS. 4A and 4B show another modified embodiment 5' of the lighting apparatus, which below will be called modified lighting apparatus. Different from the embodiment described before the modified heatsink body 6' includes a recess 8 with several parallel grooves 10, in each of which several light emitting diodes 34 are arranged. The arrangement of the light emitting diodes 34 is so selected that they are supported at uniform distances in the transverse direction 21 as well as in the longitudinal direction 7, so that a matrix structure is formed. The number of light emitting diodes used with such a lighting apparatus depends on the application and the desired light output of the lighting apparatus 5'. The distances between the lighting units 9 or respectively, the light emitting diodes may also be so selected that a certain desired lighting scheme is generated which may be regular or irregular.

In a further embodiment, the width of the recesses 8 may be adapted in the trans-verse direction 21 to the number of lighting units to be arranged side-by-side, so that a matrix-like arrangement of the lighting units 9 is obtained in a common planar recess 8 without any groove walls arranged between adjacent rows of lighting units.

In the modified lighting arrangement 5' according to FIGS. 4A, 4B, two adjacent grooves 10 are arranged in spaced relationship so that an air gap 42 is formed between the adjacent grooves 10 whereby heat removal can be improved. The air gaps 42 may also form a draining passage for liquids, in particular rain water. The air gap 42 is surrounded by the two groove walls 15, 16 of the two adjacent grooves 10. The width of the air gap 42 in the transverse direction 21 is about 20-40% and particularly 30% of the groove width n. The groove walls 15, 16 of two parallel grooves delimiting an air gap 42 are at their longitudinal ends interconnected, in each case by a transverse wall 43 whose thickness corresponds approximately to the thickness of the longitudinal groove walls 15, 16.

The modified lighting apparatus 5' also has modified heatsink ribs 20' which become narrower from the base part 17 toward their free ends. Each groove 10 is for example assigned one rib whose width at the base part 17 corresponds about to the groove width. Instead of the modified heatsink ribs 20' also the heatsink ribs 20, 20*a*, 20*b* of the first embodiment could be provided or, vice versa, the modified heatsink ribs could be used in connection with the first embodiment. The heatsink ribs 20, 20' 20*a* may also have different shapes.

The lighting apparatus 5' differs from the first embodiment also in that the parallel grooves 10 are interconnected at the in the longitudinal direction 7 opposite ends of the modified heatsink body 6'. At the opposite ends there are transverse grooves forming connection areas 46 which join the outer longitudinal grooves so that, in a planar view, a ladder-like contoured recess 8 is formed. The connecting area 46 extends in the transverse direction 21 normal to the longitudinal direction 7 of the grooves 10 and has a bottom wall at the level of the groove base 18. In this way, a common circuit board 26' can be placed into the recess 8 of the modified heatsink body 6' on which the light emitting diodes 34 are already arranged in a ladder-like pattern. This circuit board 26' has a ladder-like shape. Alternatively, it would of course also be possible to arrange in each groove 10, one or several separate strip-like circuit boards 26.

A lighting apparatus according to the invention is manufactured in the following way:

The heatsink body 6, 6' with a recess including one or more grooves 10 is provided. The heatsink body can be in the form of an extruded profiled bar. The light emitting diodes 34 and, if applicable, further electrical components 25 which are needed for the operation of the light emitting diodes are mechanically and electrically mounted onto a common circuit board or circuit board 26, 26'. The circuit board or circuit board 26, 26' is highly heat conductive and may include a highly heat conductive core of metal, for example, aluminum. The circuit board or plate 26, 26' is mounted into the groove or grooves 10 by means of a double sided self-adhesive heat conductive foil 31. Subsequently, the groove or grooves 10 at the two in the longitudinal direction 7 opposite ends of the heatsink body 6, 6' are joined by end members which are not shown so that the addition of encapsulating material into the recess 8 is possible. The end members may include openings by which electrical connecting wires leading to the light emitting diodes 34 and the electrical and electronic components 25 can be accommodated.

Subsequently, the encapsulating material 40 is filled into the groove or grooves 10, until all weather sensitive parts of the light emitting diodes 34 are covered. That means that the light emitting diodes 34 are completely encased from the base 18 of the groove 10 at least up to the diode bodies 36. The encapsulating material is then cured wherein the curing process can be performed either without any particular treatment of the encapsulating material that is it can occur by itself or for example by irradiation with UV light.

The invention concerns a lighting apparatus 5, 5' particularly for use outside of protected areas and a method for the manufacture of such an apparatus.

The lighting apparatus includes a plurality of lighting units 9, which are arranged in a common recess 8, 10 of the heatsink body 6, 6'. At the side of the heatsink body opposite the light emission direction 12 of the lighting units 9, the heatsink body 6, 6' is provided with at least one heatsink rib 20, 20'. The lighting units 9 are at least partially encased in a encapsulating material 40. The encapsulant 40 is in direct contact with the heatsink body 6, 6'.

Listing of Reference Numerals

| | |
|---|---|
| 5, 5' | Lighting apparatus |
| 6, 6' | Heatsink body/body |
| 7 | Longitudinal direction |
| 8 | Recess |
| 9 | Lighting unit |
| 9' | Lens part |
| 10 | Groove |
| 11 | Height direction |
| 12 | Light emission direction |
| 15, 16 | Groove walls |
| 17 | Base part |
| 18 | Base |
| 20a, 20b, 20, 20' | Heatsink ribs |
| 21 | Transverse direction |
| 22, 23 | Planar outer surfaces |
| 25 | Electronic component |
| 26 | Circuit board |
| 30 | Heat conductor layer |
| 31 | Adhesive foil |
| 34 | Light emitting diode |
| 35 | Diode chip |
| 36 | Diode base |

-continued

| Listing of Reference Numerals | |
|---|---|
| 40 | Enclosure |
| 42 | Air gap |
| 43 | Transverse wall |
| 46 | Connecting area |

We claim:

1. A lighting apparatus comprising:

a heatsink having a first side and a second side;

at least one groove defined in the first side of the heatsink by groove walls and having a groove opening;

a plurality of lighting units positioned within the at least one groove and oriented in a light emission direction facing toward the groove opening, each lighting unit comprising a light emitting diode having a diode chip and a diode lens;

a plurality of heatsink ribs along the second side of the heatsink; and an encapsulating material located in the at least one groove in direct contact with the first side of the heatsink and external the plurality of lighting units to at least partially encapsulate the plurality of lighting units, wherein the groove walls are formed from a metallic material.

2. The lighting apparatus of claim 1, wherein the heatsink is formed as a single member.

3. The lighting apparatus of claim 1, wherein the heatsink is formed by an extruded section.

4. The lighting apparatus of claim 1, further comprising a circuit board disposed within the at least one groove and encapsulated by the encapsulating material.

5. The lighting apparatus of claim 4, wherein the lighting units are positioned on the circuit board.

6. The lighting apparatus of claim 4, further comprising a self-adhesive heat conducting layer disposed between the circuit board and the heatsink.

7. The lighting apparatus of 1, wherein the circuit board has a width and wherein the at least one groove has a width which is 30% to 50% greater than the width of the circuit board.

8. The lighting apparatus of claim 1, wherein each of the heatsink ribs has a width which is 5 to 20% less than the width of the at least one groove.

9. The lighting apparatus of claim 1, wherein the at least one groove comprises a first groove and a second groove defined in the first side of the heatsink and extending parallel to one another, wherein the plurality of lighting units are disposed within the first groove and the second groove.

10. The lighting apparatus of claim 9, further comprising an air gap formed between the first groove and the second groove.

11. The lighting apparatus of claim 10, wherein the air gap is open to the second side of the heatsink to provide a drainage passage through the apparatus.

12. The lighting apparatus of claim 1, wherein the diode lens of at least some of the plurality of lighting units is not fully encapsulated by the encapsulating material.

13. The lighting apparatus of claim 1, wherein at least some of the plurality of the lighting units are fully encapsulated by the encapsulating material.

14. The lighting apparatus of claim 1, wherein at least some of the plurality of the lighting units are not fully encapsulated by the encapsulating material.

15. A method for the manufacture of a lighting apparatus comprising:

a. providing a heatsink having:

(i) a first side; and (ii) at least one groove defined in the first side by groove walls and extending in a lengthwise direction along the first side, wherein the at least one groove comprises a groove opening;

b. positioning a plurality of lighting units within the at least one groove so that the light emission direction of the plurality of lighting units faces toward the groove opening, each lighting unit comprising a light emitting diode having a diode chip and a diode lens;

c. adding an encapsulating material into the at least one groove so that the encapsulating material is in direct contact with the first side of the heatsink and external the plurality of lighting units to at least partially encapsulate the plurality of lighting units; and d. curing the encapsulating material to at least partially seal the plurality of lighting units in an encapsulant formed by the cured encapsulating material, wherein the groove walls are formed from a metallic material.

16. The method of claim 15, wherein the heatsink further comprises a plurality of heatsink ribs positioned on a second side of the heat sink opposite the first side.

17. The method of claim 15, wherein adding an encapsulating material into the at least one groove comprises fully encapsulating at least some of the plurality of lighting units with the encapsulating material.

18. The method of claim 15, wherein adding the encapsulating material into the at least one groove comprises adding the encapsulating material into the at least one groove so that the encapsulating material does not encapsulate the diode lens of at least some of the plurality of lighting units.

19. A lighting apparatus comprising:

a. a heatsink comprising:

i. a heatsink body;

ii. a first and a second groove wall defining at least one groove on a first side of the heatsink body, wherein the at least one groove comprises a groove opening;

iii. a plurality of ribs extending along a second side of the heatsink body, b. a plurality of lighting units positioned within the at least one groove and oriented in a light emission direction facing toward the groove opening, each lighting unit comprising a light emitting diode having a diode chip and a diode lens; and c. an encapsulating material located in the at least one groove in direct contact with the first side of the heatsink body and external the plurality of lighting units to at least partially encapsulate the plurality of lighting units, wherein the heatsink body and first and second groove walls are integrally formed from a metallic material.

20. The lighting apparatus of claim 19, wherein the heatsink is formed by an extruded section.

21. The lighting apparatus of claim 19, further comprising a circuit board disposed within the at least one groove and encapsulated by the encapsulating material.

22. The lighting apparatus of claim 21, wherein the plurality of lighting units are positioned on the circuit board.

23. The lighting apparatus of claim 21, further comprising a self-adhesive heat conducting layer disposed between the circuit board and the heatsink.

24. The lighting apparatus of 21, wherein the circuit board has a width and wherein the at least one groove has a width which is 30% to 50% greater than the width of the circuit board.

25. The lighting apparatus of claim 19, wherein the diode lens of at least some of the plurality of lighting units is not fully encapsulated by the encapsulating material.

26. The lighting apparatus of claim 19, wherein at least some of the plurality of the lighting units are fully encapsulated by the encapsulating material.

27. The lighting apparatus of claim 19, wherein at least some of the plurality of the lighting units are not fully encapsulated by the encapsulating material.

* * * * *